US012312707B2

(12) United States Patent
Sui et al.

(10) Patent No.: US 12,312,707 B2
(45) Date of Patent: May 27, 2025

(54) PREPARATION METHOD FOR GRAPHENE OXIDE FIBER, AND FIBER OBTAINED THEREBY

(71) Applicant: QINGDAO UNIVERSITY, Shandong (CN)

(72) Inventors: Kunyan Sui, Shandong (CN); Yanzhi Xia, Shandong (CN); Na Pan, Shandong (CN); Min Lin, Shandong (CN); Wenxin Fan, Shandong (CN); Huilin Cui, Shandong (CN); Yuyu Li, Shandong (CN)

(73) Assignee: QINGDAO UNIVERSITY, Shandong (CN)

( * ) Notice: Subject to any disclaimer, the term of this patent is extended or adjusted under 35 U.S.C. 154(b) by 819 days.

(21) Appl. No.: 17/607,762

(22) PCT Filed: Apr. 30, 2020

(86) PCT No.: PCT/CN2020/088500
§ 371 (c)(1),
(2) Date: Oct. 29, 2021

(87) PCT Pub. No.: WO2020/221361
PCT Pub. Date: Nov. 5, 2020

(65) Prior Publication Data

US 2022/0205139 A1 Jun. 30, 2022

(30) Foreign Application Priority Data

Apr. 30, 2019 (CN) ..... 201910362369.X

(51) Int. Cl.
*D01D 5/06* (2006.01)
*D01D 1/02* (2006.01)

(52) U.S. Cl.
CPC ..... *D01D 5/06* (2013.01); *D01D 1/02* (2013.01); *D10B 2101/12* (2013.01)

(58) Field of Classification Search
CPC ..... D01D 5/06; D01D 1/02; D10B 2101/12; D01F 9/00; D01F 1/10; D01F 8/18;
(Continued)

(56) References Cited

U.S. PATENT DOCUMENTS

2019/0040550 A1* 2/2019 Han ..... D01D 1/02

FOREIGN PATENT DOCUMENTS

WO WO2000001373 A1 1/2000

* cited by examiner

*Primary Examiner* — Daniel C. McCracken
(74) *Attorney, Agent, or Firm* — Adam Warwick Bell

(57) ABSTRACT

Disclosed in the present invention are a preparation method for a graphene oxide fiber, and fiber obtained thereby. A polyelectrolyte is prepared into a spinning stock solution by means of a wet spinning method, graphene oxide is added in a coagulation tank to serve as a coagulation bath, the spinning stock solution is injected into the coagulation bath, a diffusion reaction is carried out, and winding, washing and drying are carried out to obtain the graphene oxide fiber; the preparation method has the advantages that equipment is simple, the costs are low, the spinnability is good, and the method is suitable for large-scale production; moreover, the prepared fiber has multiple layers of fiber walls; the fiber has good tensile strength and a super-high specific surface area and is widely applied to the fields of catalysis, adsorption, flexible sensors, thermal preservation and insulation materials and tissue engineering.

17 Claims, 1 Drawing Sheet

(58) Field of Classification Search
CPC ... C01B 32/182; C01B 32/184; C01B 32/186; C01B 32/188; C01B 32/19; C01B 32/192; C01B 32/194; C01B 32/196; C01B 32/198; C01B 2204/00; C01B 2204/02; C01B 2204/04; C01B 2204/06; C01B 2204/065; C01B 2204/20; C01B 2204/22; C01B 2204/24; C01B 2204/26; C01B 2204/28; C01B 2204/30; C01B 2204/32; C01B 32/20; C01B 32/205; C01B 32/21; C01B 32/215; C01B 32/22; C01B 32/225; C01B 32/23
See application file for complete search history.

PREPARATION METHOD FOR GRAPHENE OXIDE FIBER, AND FIBER OBTAINED THEREBY

TECHNICAL FIELD

The invention relates to graphene oxide fiber, specifically the preparation for graphene oxide fiber, in particular to a preparation method for graphene oxide fiber with multi-layer fiber walls and fiber obtained thereby.

BACKGROUND OF THE INVENTION

Layered structures abound in nature. Various organisms spontaneously assemble and accumulate through various weak interactions between molecular fragments to form multi-layer spatial structures, and finally realize their biological functions, for example, shells and tree rings, etc. are arranged in highly repetitive multi-layer patterns. Inspired by nature, scientists have carried out in-depth bionic design, preparation and theoretical research of multi-layer structure materials.

At present, the preparation of multi-layer structure materials is mainly based on LBL method. At first, LBL was a method to construct multilayer thin film materials by alternate layer-by-layer deposition based on electrostatic complexation between anions and cations of polyelectrolyte, and then extended to some weak forces such as hydrogen bonding, charge transfer and molecular recognition, etc.

The preparation of multi-layer structure materials can also be realized by microfluidic technology. Due to the rapid heat transfer and the accurate control of reaction conditions such as reaction temperature and effective reaction time, microfluidic can realize the construction of multi-layer and complex structure fiber.

Graphene is a two-dimensional carbon nanomaterial with the thickness of one atom layer formed by the bond of carbon atoms in $sp^2$ hybridization. It has excellent mechanical, electrical, thermal and magnetic properties and is the focus of current research. Graphene fiber is an assembly of graphene nanosheets in one-dimensional confined space, which makes the excellent performance of graphene in nano-scale inherited to macro-scale, and greatly expands the application field of graphene. Functional multi-layer fibers can be obtained by preparing multi-layer fibers from graphene.

However, the multi-layer structure fiber constructed by microfluidic can only be called partition fiber, and its size is limited to micro-nano scale. The diameter of the fiber is 100~200 μm, the length is in the range of several meters, and the number of layers is at most three, and there is no interval between layers. Therefore, the preparation of multilayer structure fiber in macro-scale sense still cannot be broken through.

SUMMARY OF THE INVENTION

In order to overcome the above problems, the inventor has made determined research to provide a preparation method of multi-layer structure graphene oxide fiber with simple process and environmental protection, which has low preparation cost and is suitable for large-scale production. At the same time, the fiber wall of the prepared graphene oxide fiber is a single layer or a plurality of layers, thereby completing the invention.

In the first aspect of the invention, a method for preparing graphene oxide fiber is provided, and it is embodied in the following aspects:

(1) a method for preparing graphene oxide fiber, wherein the method comprises the following steps:

step 1, adding polyelectrolyte into water to obtain spinning stock solution;

step 2, adding graphene oxide into water, optionally stirring and/or ultrasonic processing, to obtain coagulation bath;

step 3, injecting the spinning stock solution obtained in step 1 into the coagulation bath obtained in step 2, and winding, washing and drying to obtain the graphene oxide fiber.

(2) according to the above preparation method (1), wherein, in step 1, the polyelectrolyte is polyelectrolyte with positive charge, preferably one or more selected from chitosan oligosaccharide, polyallylamine hydrochloride and poly (N, N-dimethylaminoethyl methacrylate), such as chitosan oligosaccharide.

(3) according to the above preparation method (1) or (2), wherein, in step 1, the molecular weight of the polyelectrolyte is 2000-10000 Da, preferably 2000-6000 Da.

(4) according to the above one of preparation methods (1) to (3), wherein, in step 1, the mass percentage concentration of the polyelectrolyte in the spinning stock solution is 5-60%, preferably 5-40%, more preferably 5-20%, such as 5-10%, based on the total mass of the spinning stock solution.

(5) according to the above one of preparation methods (1) to (4), wherein, in step 2, the mass percentage concentration of the graphene oxide in the coagulation bath is 0.2-1%, preferably 0.2-0.5%, based on the total mass of the coagulation bath.

(6) according to the above one of preparation methods (1) to (5), wherein, in step 1, the pH of the obtained spinning stock solution is optionally adjusted to 2-6, preferably, optionally adjusted to 3.5-5.

(7) according to the above one of preparation methods (1) to (6), wherein, in step 3, the obtained fiber is optionally immersed in a multi-valent cationic salt solution.

(8) according to the above one of preparation methods (1) to (7), wherein the concentration of the multi-valent cationic salt solution is 1-10%, preferably 3-8%, such as 5%, based on the total mass of the multivalent cationic salt solution.

In the second aspect of the invention, a graphene oxide fiber is provided, preferably obtained by the above one of preparation methods (1) to (8), preferably the graphene oxide fiber has a hollow structure, and more preferably it has single-layered or multi-layered fiber wall, such as multi-layered fiber wall.

The graphene oxide fiber provided by the invention has a hollow structure and has single-layered or multi-layered fiber wall, and the constituent component of the graphene oxide fiber comprises graphene oxide and polyelectrolyte.

In another preferred embodiment, the polyelectrolyte is polyelectrolyte with positive charge, preferably selected from chitosan oligosaccharide, polyallylamine hydrochloride and poly (N, N-dimethylaminoethyl methacrylate).

In another preferred embodiment, the fiber wall of the graphene oxide fiber is multi-layered.

In another preferred embodiment, the graphene oxide and the polyelectrolyte in the graphene oxide fiber are electrostatically bound together.

In another preferred embodiment, the graphene oxide fiber has multi-layered fiber wall, and the aperture of each fiber wall (or capsule wall) gradually increases from inside to outside, showing a gradient structure.

In the third aspect of the invention, an article is provided, the article comprises or is made of the graphene oxide fiber according to the second aspect of the invention.

It should be understood that in the present invention, any of the technical features specifically described above and below (such as in the Example) can be combined with each other, thereby constituting new or preferred technical solutions. Limited by space, it is not repeated here.

DETAILED DESCRIPTION OF THE INVENTION

Figure 1:
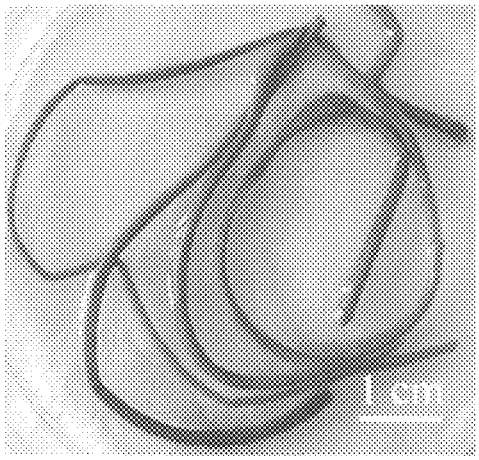
FIG. 1 shows a macroscopic photograph of graphene oxide fiber prepared in Example 1.

The present invention is described in further detail below by way of examples and experimental examples. The features and advantages of the present invention will become clearer with these descriptions.

In one aspect of the invention, a preparation method of graphene oxide fiber is provided, wherein, the method comprises the following steps:

- step 1, polyelectrolyte is added into water to obtain spinning stock solution;
- step 2, graphene oxide is added into water, optionally stirring and/or ultrasonic processing, to obtain coagulation bath;
- step 3, the spinning stock solution obtained in step 1 is injected into the coagulation bath obtained in step 2, and wound, washed and dried to obtain the graphene oxide fiber.

According to a preferred embodiment of the invention, the polyelectrolyte is polyelectrolyte with positive charge.

In this way, the electrostatic interaction between polyelectrolyte and graphene oxide (with opposite positive and negative charges respectively) can be used to make them complex to form a polyelectrolyte complex film. Then, driven by osmotic pressure, polyelectrolyte can spontaneously pass through the complex film and continue to diffuse in the direction of graphene oxide, and then complex with graphene oxide again to form a new complex film. The solution spontaneously repeats the complexation-diffusion-recomplexation process, and the fibers with monolayer or multilayer structure can be obtained controllably.

In a further preferred embodiment, the polyelectrolyte is one or more selected from chitosan oligosaccharide, polyallylamine hydrochloride, poly (N, N-dimethylaminoethyl methacrylate), such as chitosan oligosaccharide.

In the invention, the obtained fiber with multi-layer structure has wide application in the fields of adsorption, filtration and tissue engineering.

The reason lies that (1) polyelectrolyte and graphene oxide have positive and negative charges respectively. Even if they can react by complexion, there are still charged functional groups in the molecular chain that do not participate in the reaction, which become potential binding sites that can react with organic dyes. Therefore, these binding sites can have electrostatic interaction with ionic dyes with positive or negative charges to realize adsorption. (2) The reason why the prepared fiber has filtration performance lies that the fiber itself has a multi-layer structure, the aperture of each layer is different from inside to outside, showing a gradient structure. Therefore, the fiber can meet the use requirements by gradually stratifying filtration from surface to inner layer according to different particle sizes. Mixed dust in the fluid enters the filter material from the surface layer, larger particle size particles are intercepted by the surface layer, medium particle size particles are adsorbed in the middle, and tiny particle size particles are blocked by the inner layer. (3) The application of fiber in electrical field is due to the good conductivity of graphene obtained by reducing graphene oxide.

According to a preferred embodiment of the invention, in step 1, the molecular weight of the polyelectrolyte is 2000-10000 Da.

In a further preferred embodiment of the invention, in step 1, the molecular weight of the polyelectrolyte is 2000-6000 Da.

Among them, if the number average molecular weight of polyelectrolyte is less than 2000 Da, in the complexation reaction with graphene oxide, due to the few binding sites between polyelectrolyte and graphene oxide, the entanglement is not enough to support the film formation and then form fiber, finally form complex precipitate particles. At the same time, if the number average molecular weight of the polyelectrolyte is greater than 10000 Da, the structure of the complex layer formed by the electrostatic complex reaction between the polyelectrolyte and graphene oxide is compact, the polyelectrolyte cannot pass through, the diffusion process is prevented, and finally the hollow structure cannot be formed.

According to a preferred embodiment of the invention, in step 1, the mass percentage concentration of the polyelectrolyte in the spinning stock solution is 5-60%, based on the total mass of the spinning stock solution.

In a further preferred embodiment, in step 1, the mass percentage concentration of the polyelectrolyte in the spinning stock solution is 5-40%, based on the total mass of the spinning stock solution.

In a further preferred embodiment, in step 1, the mass percentage concentration of the polyelectrolyte in the spinning stock solution is 5-20%, such as 5-10%, based on the total mass of the spinning stock solution.

After extensive experiments, the inventor found that the concentration of the polyelectrolyte in the spinning stock solution has an important effect on the number of layers of the resulting graphene oxide fiber. Specifically, increasing the concentration of the polyelectrolyte in the spinning stock solution can make the fiber change from single layer to multilayer, and the layer number of multilayer fiber increases with the increase of concentration. Thus, the multi-layer hollow fiber with controllable number of layers can be obtained by the method of the invention, i.e. n-layer hollow fibers can be obtained, wherein n is a positive integer≥2, preferably n≥4, preferably ≥6, such as 2-20, preferably 4-20.

According to a preferred embodiment of the invention, in step 2, the mass percentage concentration of the graphene oxide in the coagulation bath is 0.2-1%, based on the total mass of the coagulation bath.

In a further preferred embodiment, in step 2, the mass percentage concentration of the graphene oxide in the coagulation bath is 0.2-0.5%, based on the total mass of the coagulation bath.

The polyelectrolyte is controlled at a higher concentration (5-60%), while the graphene oxide is controlled at a relatively low concentration (0.2-1%), so that the two forms osmotic pressure due to the difference of ion concentration, and the polyelectrolyte diffuses to graphene oxide under the osmotic pressure, and then combines with each other by electrostatic action to obtain fiber.

According to a preferred embodiment of the invention, in step 1, the pH of the spinning stock solution is optionally adjusted to 2-6.

The charge density can be changed by adjusting the pH of the reaction system because the polyelectrolyte has a certain acidity coefficient pKa, and then the electrostatic complexation degree between polyelectrolyte and graphene oxide can be affected. Specifically, the farther away from the acidity coefficient pKa, the greater the charge density, the stronger the binding force between polyelectrolyte and graphene oxide, and the more compact the structure of the complex film obtained. On the contrary, the closer to the acidity coefficient pKa, the smaller the charge density, the weaker the binding force between polyelectrolyte and graphene oxide, and the looser the structure of the complex film obtained.

In a further preferred embodiment, in step 1, the pH of the spinning stock solution is optionally adjusted to 3.5-5.

Therefore, in acidic pH environment, multilayer fibers with loose capsule wall can be obtained, thus making the fiber with better adsorption performance.

According to a preferred embodiment of the invention, in step 3, after the fiber is obtained, it is optionally immersed in a multivalent cationic salt solution, such as calcium chloride, etc.

After immersion in multivalent cationic salt, cross-linking occurs between cationic salt and molecular chain, which can change the cross-linking density and mechanical strength of fiber.

In a further preferred embodiment, the concentration of the multivalent cationic salt solution is 1-10%, preferably 3-8%, e.g. 5%.

In another aspect of the invention, graphene oxide fiber obtained by the method described in the first aspect is provided.

According to a preferred embodiment of the invention, the graphene oxide fiber has hollow structure.

In a further preferred embodiment, the fiber wall is single-layered or multi-layered, e.g. multi-layered fiber wall, preferably each layer is porous.

Thus, the hollow multilayer graphene oxide fiber is obtained.

In a further preferred embodiment, when in a multi-layer structure, the aperture of each layer is different, preferably, the aperture of the capsule wall of each layer gradually increases from inside to outside, showing a gradient structure.

In this way, the fiber can meet the use requirements by gradually stratifying filtration from surface to inner layer according to different particle sizes. Mixed dust in the fluid enters the filter material from the surface layer, larger particle size particles are intercepted by the surface layer, medium particle size particles are adsorbed in the middle, and tiny particle size particles are blocked by the inner layer.

In addition, the fiber has good tensile strength and ultra-high specific surface area, and is widely used in the fields of catalysis, adsorption, flexible sensors, thermal insulation materials and tissue engineering.

The invention has the following beneficial effects:

(1) the preparation method of the invention is simple, the fiber can be prepared at normal temperature and normal pressure, and the preparation process is carried out at normal temperature and normal pressure, the process parameters are easy to control, and the invention has high production efficiency;

(2) the fiber with single layer structure or several layers structure can be prepared by using the preparation method of the invention, and more importantly, the pore diameter gradient and the number of layers of the fiber can be arbitrarily adjusted and controlled according to needs.

(3) the fiber obtained by the preparation method of the invention has good tensile strength and ultra-high specific surface area, and is widely used in the fields of catalysis, adsorption, filtration, electricity, etc.

EXAMPLE

The present invention will be further illustrated below with reference to the specific examples. It should be understood that these examples are only to illustrate the invention but not to limit the scope of the invention. In the following examples where specific conditions are not specified, the test method is usually in accordance with conventional conditions or those recommended by the manufacturer. Unless indicated otherwise, parts and percentage are calculated by weight.

Example 1

According to the mass ratio of 20:1, chitosan oligosaccharide with molecular weight of 2000 Da and graphene oxide were weighed for later use.

The chitosan oligosaccharide was dissolved in deionized water to obtain a spinning stock solution with a mass percentage concentration of 10% (i.e., the mass percentage concentration of chitosan oligosaccharide was 10%).

The graphene oxide was added into water, stirred under magnetic and ultrasonic processed, and prepared into a coagulation bath with a mass percentage concentration of 0.5%.

The spinning stock solution was injected into the coagulation bath through a syringe to carry out the diffusion reaction, and then wound, washed and dried to obtain the graphene oxide fiber.

The macroscopic figure of the fiber obtained in Example 1 was shown in FIG. 1. The diameter was about 1.5-3.5 mm, and the average diameter was about 2.5 mm.

Figure 2:
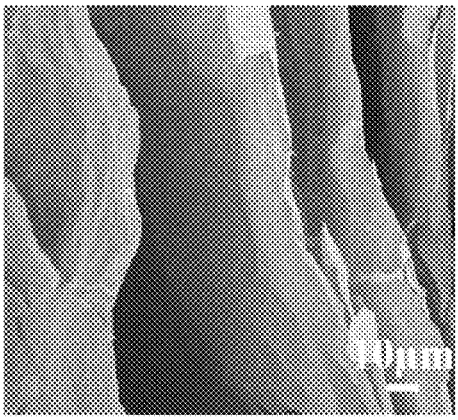
FIG. 2 is one of the electron microscope photographs (mainly showing the layer-by-layer structure) of graphene oxide fibers produced in Example 1.

At the same time, the obtained fiber was detected by scanning electron microscope, and the results were shown in FIG. 2. It could be seen that the fiber wall was multi-layer structure.

The pore-like structure can be clearly seen after enlarging the fiber wall of each layer of the fiber, and the pore size of each layer is different. Preferably, the pore size of capsule wall of each layer gradually increases from inside to outside, showing a gradient structure.

Example 2

The procedure of Example 1 was repeated with the difference that the concentration of chitosan oligosaccharide was 20%.

The obtained fiber was detected by electron microscope, and found to be hollow multi-layer structure.

Example 3

The procedure of Example 1 was repeated with the difference that the concentration of chitosan oligosaccharide was 30%.

The obtained hollow multi-layer fiber was detected by electron microscope, and found to be hollow multi-layer structure.

Example 4

The procedure of Example 1 was repeated with the difference that the molecular weight of chitosan oligosaccharide was 3000 Da. The obtained hollow multi-layer fiber was detected by electron microscope, and found to be hollow multi-layer structure.

COMPARATIVE EXAMPLE

Comparative Example 1

The procedure of Example 1 was repeated with the difference that the mass percentage concentration of graphene oxide in the coagulation bath was very low, only 0.05%.

It was found that precipitates would form when the concentration of graphene oxide was very low. Due to the insufficient entanglement between chitosan oligosaccharide and graphene oxide, the binding sites were insufficient, and only precipitates were formed, which was not enough to support the film.

EXPERIMENTAL EXAMPLE

Experimental Example 1 XRD Detection

Figure 3:
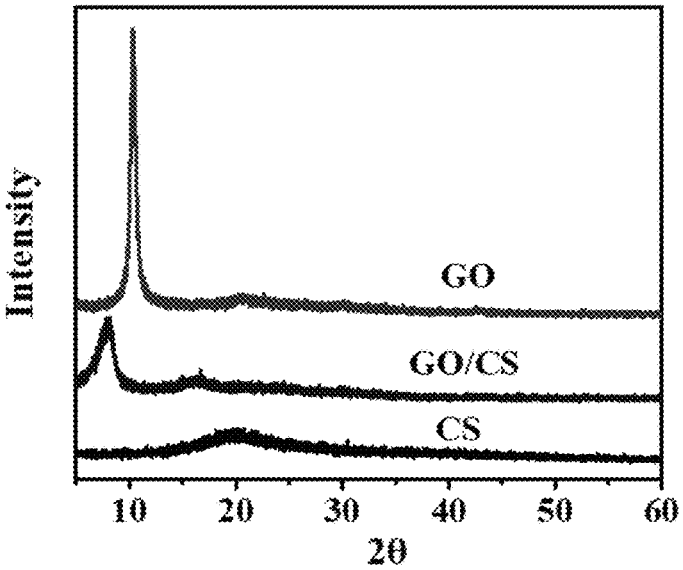
FIG. 3 shows XRD patterns of graphene oxide (GO), chitosan oligosaccharide (CS), and fiber (GO/CS) obtained in Example 1.

The fiber obtained in Example 1 was tested by XRD, and the results were shown in FIG. 3, which included the XRD curves of graphene oxide (GO), chitosan oligosaccharide (CS) and the fiber (GO/CS) obtained in Examples.

As could be seen from FIG. 3, the absorption peak at 2 θ=10. 57 degrees belonging to graphene oxide in the obtained fiber (GO/CS) disappeared, and correspondingly the peak of GO in the fiber appeared at 2 θ=7. 9 degrees. According to Bragg equation, the interlamellar spacing of GO increased from 8.4 Å to 8.72 Å. This result showed that chitosan oligosaccharide was inserted into the lamellar of graphene oxide (GO) in fiber.

The present invention has been described in detail above in combination with preferred embodiments and exemplary examples. However, it should be stated that these embodiments are only illustrative explanations of the present invention and do not limit the scope of protection of the present invention in any way. Various modifications, equivalent substitutions or modifications may be made to the technical content of the present invention and its embodiments without departing from the spirit and scope of the present invention, all of which fall within the scope of the present invention. The scope of protection of the invention shall be subject to the appended claims.

The invention claimed is:

1. A preparation method for graphene oxide fiber, wherein the method comprises the following steps:

step 1: adding polyelectrolyte into water to obtain spinning stock solution wherein the polyelectrolyte is chitosan oligosaccharide, the molecular weight of the polyelectrolyte is 2000-10000 Da;

step 2: adding graphene oxide into water, optionally stirring and/or ultrasonic processing, to obtain coagulation bath;

step 3: injecting the spinning stock solution obtained in step 1 into the coagulation bath obtained in step 2, and winding, washing and drying to obtain the graphene oxide fiber.

2. The preparation method of claim 1, wherein in step 1, the molecular weight of the polyelectrolyte is 2000-6000 Da.

3. The preparation method of claim 1, wherein in step 1, the mass percentage concentration of the polyelectrolyte in the spinning stock solution is 5-60%.

4. The preparation method of claim 1, wherein in step 1, the pH of the obtained spinning stock solution is adjusted to 2-6.

5. The preparation method of claim 3, wherein in step 1, the mass percentage concentration of the polyelectrolyte in the spinning stock solution is 5-40%.

6. The preparation method of claim 3, wherein in step 1, the mass percentage concentration of the polyelectrolyte in the spinning stock solution is 5-20%.

7. The preparation method of claim 1, wherein in step 2, the mass percentage concentration of the graphene oxide in the coagulation bath is 0.2-1%.

8. The preparation method of claim 7, wherein in step 2, the mass percentage concentration of the graphene oxide in the coagulation bath is 0.2-0.5%.

9. The preparation method of claim 4, wherein in step 1, the pH of the obtained spinning stock solution is adjusted to 3.5-5.

10. The preparation method of claim 1, wherein in step 3, after the fiber is obtained, it is optionally immersed in a multivalent cationic salt solution.

11. The preparation method of claim 10, wherein the concentration of the multivalent cationic salt solution is 1-10%.

12. The preparation method of claim 11, wherein the concentration of the multivalent cationic salt solution is 3-8%.

13. The preparation method of claim 11, wherein the concentration of the multivalent cationic salt solution is 5%.

14. A graphene oxide fiber, obtained by the preparation method of claim 1, wherein the graphene oxide fiber has a hollow structure and has a single-layer fiber wall, or multi-layer fiber wall where an aperture of each fiber wall gradually increases from inside to outside, showing a gradient structure; wherein the graphene oxide fiber comprises a polyelectrolyte wherein the polyelectrolyte is a chitosan oligosaccharide and the molecular weight of the polyelectrolyte is 2000-10000 Da.

15. The graphene oxide fiber of claim 14, wherein the fiber wall of the graphene oxide fiber is multi-layered.

16. The graphene oxide fiber of claim 14, wherein the graphene oxide and the polyelectrolyte in the graphene oxide fiber are electrostatically bound together.

17. An article, wherein the article comprises or is made of the graphene oxide fiber of claim 14.

* * * * *